United States Patent [19]

Schippers et al.

[11] 4,165,600

[45] Aug. 28, 1979

[54] APPARATUS FOR OPEN-END SPINNING OF FIBERS

[75] Inventors: Heinz Schippers; Herbert Turk, both of Remscheid; Herbert Schiminski, Hückeswagen; Peter Dammann, Remscheid, all of Fed. Rep. of Germany

[73] Assignee: Barmag Barmer Maschinenfabrik AG, Remscheid-Lennep, Fed. Rep. of Germany

[21] Appl. No.: 937,798

[22] Filed: Aug. 29, 1978

[30] Foreign Application Priority Data

Sep. 1, 1977 [DE] Fed. Rep. of Germany ..... 2739410

[51] Int. Cl.[2] ..... D01H 1/12

[52] U.S. Cl. ..... 57/58.95; 57/58.89

[58] Field of Search ..... 57/58.89–58.95, 57/5, 334, 335

[56] References Cited

U.S. PATENT DOCUMENTS

| | | | |
|---|---|---|---|
| 824,792 | 7/1906 | Jerrems | 57/58.95 |
| 2,202,118 | 5/1940 | Newman et al. | 57/58.91 X |
| 3,913,310 | 10/1975 | Fehrer | 57/58.89 X |
| 3,972,173 | 8/1976 | Fehrer | 57/58.89 |
| 4,060,966 | 12/1977 | Konig | 57/58.89 |

*Primary Examiner*—John Petrakes

*Attorney, Agent, or Firm*—John H. Shurtleff

[57] ABSTRACT

Apparatus for open-end spinning of discrete fibers in a narrow gap between adjacent, air permeable surfaces of two tapered drums whose axes of revolution are at an acute angle and which rotate in the same direction, while drawing air through said surfaces along said gap, said tapered surfaces being frusto-conical or being a segment of a hyperboloid of revolution, and fiber feed means having a channel with an elongated, narrow mouth extending along said gap.

6 Claims, 3 Drawing Figures

APPARATUS FOR OPEN-END SPINNING OF FIBERS

BACKGROUND OF THE INVENTION

Figure 1:
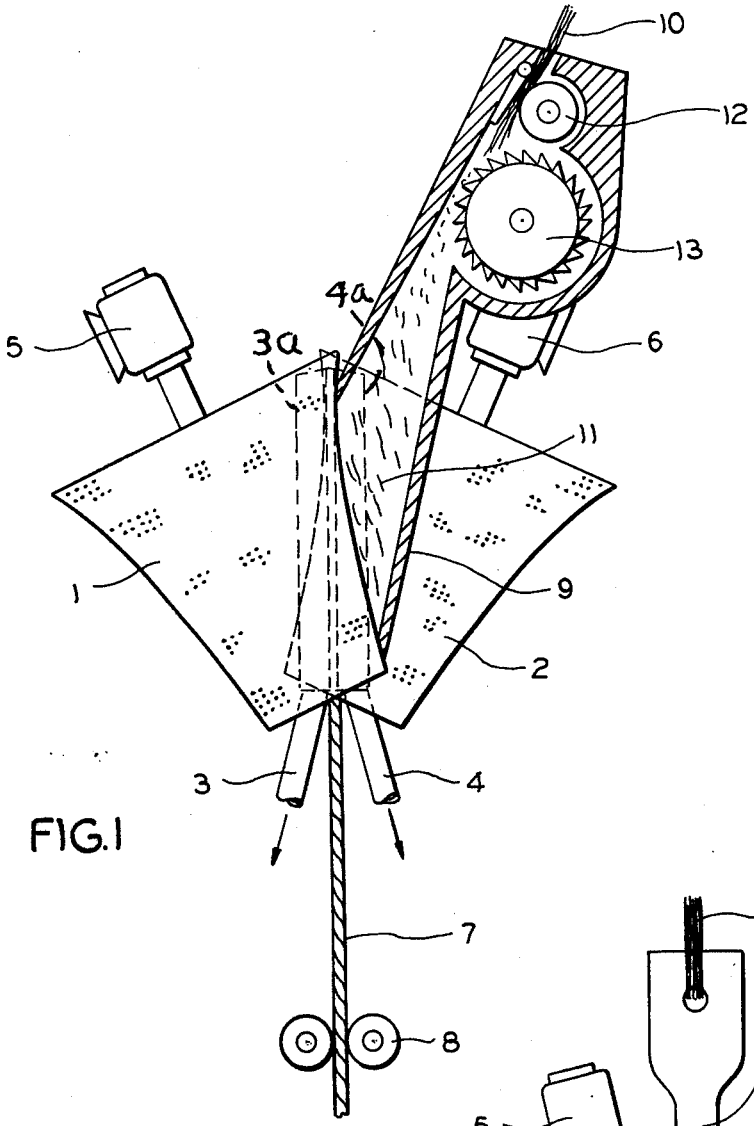

Open-end spinning of discrete fibers involves imparting twist to a body of discrete fibers to spin them into a yarn in a zone wherein the open end is the area where the discrete fibers are twisted initially. Previously known methods of open end or break spinning have been classified by the Shirley Institute in four groups. Two of these groups are vortex systems in which the open end of the yarn is twisted in a fluid vortex, usually air; and circumferential assembly systems in which fibers are conveyed in an airstream and are spun on a rapidly rotating cylindrical surface.

Examples of the latter type are disclosed, for example, in U.S. application Serial No. 782,310, filed by Dammann et al, on Mar. 28, 1977, now U.S. Pat. No. 4,130,983. That application also discloses that the rotating surfaces may be air permeable, symmetric or asymmetric hyperboloids of revolution.

The hyperboloids of revolution are arranged in such a way that their axes are located in planes parallel to each other or that each of them has a generating line which is parallel to the yarn formation line. The yarn formation line is the zone of the narrowest gap formed between the hyperboloids. Along said gap the air entrant nozzles of suction devices are arranged inside the hyperboloids of revolution. The hyperboloid surfaces terminate in a normal plane at each end. They may be asymmetrical in such a way that they do not have any plane of symmetry which is normal to their axes, whereby inadmissibly great tension forces are not exerted on the yarn being spun. The technical requirements are normally satisfied also by bodies of revolution which are cylindrical or constitute bodies of revolution of a parabola segment or any other curve segment which bulges outwardly from the axis of rotation. However, especially for the processing of polyester textile fibers (polyethylene terephthalate), the above mentioned spinning devices were afflicted by an uncertainty in operation, especially by the fact that the spinning results could not be reproduced with sufficient accuracy.

THE INVENTION

This disadvantage can be eliminated if the surfaces, as proposed in the present invention, are formed by segments of bodies of revolution which have a diameter which becomes continuously smaller in the axial direction, and are arranged in such a way that the yarn being formed runs through the zone of the most narrow opening in the direction from the larger to the smaller ends of the bodies of revolution. In order to obtain the conveying effect as defined in said application, the invention herein uses those segments of a hyperboloid of revolution whose transverse section planes are located on only one side of their transverse plane of symmetry, i.e., planes which are normal to the axis of revolution.

The fiber feed channel has an elongated narrow mouth which is essentially parallel to gap and approximates the narrowest gap as much as possible. The plane of the mouth opening lies at an angle of less than 20° relative to the gap. A length of approximately $\frac{2}{3}$ of the length of the hyperboloids of revolution is used, the mouth beginning at the ends of larger diameter.

By this design of the spinning apparatus as defined in the invention, the fibers which enter the narrowest gap, are first twisted together with a high torque in the zone of the larger ends of the hyperboloids of revolution so that the formed yarn has already in the zone of the smaller ends a tensile strength so great that the tension forces occurring in spite of the conveying by the rotating bodies can be endured. By means of the spinning apparatus as defined in the invention, breaking of the yarn can be eliminated almost entirely and the formation of the yarn and the spinning result becomes almost completely reproducable.

THE ILLUSTRATED EMBODIMENTS

Figure 1A:
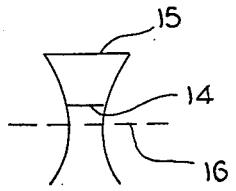
Figure 2:
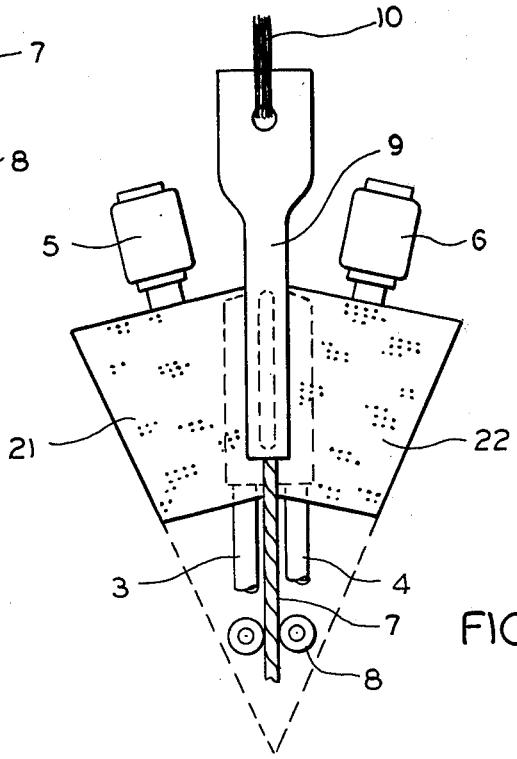

Preferred embodiments of the invention are illustrated in the drawings, wherein:

FIG. 1 is a side elevation, partly in vertical section, of an open end fiber spinning apparatus with a discrete (staple) fiber feed unit and a pair of hyperbolic type of perforated, air permeable bodies of rotation;

FIG. 1*a* is a diagram of a hyperboloid of revolution showing the segment thereof used to provide the geometric shape of the bodies of rotation in FIG. 1; and FIG. 2 is a top plan view of a second embodiment of an open end fiber spinning apparatus, with a pair of frusto-conical, perforated, air permeable bodies of rotation.

Referring to FIG. 1, the perforated, air permeable surfaces of the hollow drums 1 and 2 are asymmetric segments of a hyperboloid of revolution. The opposed portions of generatrices of such surfaces across the gap therebetween define a straight line which crosses the axes of rotation of the drums 1 and 2.

In actual practice, the drums 1 and 2 need not have precise, partial, hyperbolic concavity for their perforate, air permeable surfaces of revolution. Close approximations thereto may be used without relinquishing the improvements and advantages provided by this invention.

The asymmetry of the drums means that said drums have no normal planes to which the two ends of the drums are mirrorsymmetrical. As shown in FIG. 1*a*, the transverse sectional planes 14 and 15 at both ends of both ends of each drum are both on only one side of the transverse plane of symmetry 16 in such a way that the diameter of the hyperboloid of revolution only decreases from one end to the other. The transvere planes mentioned above are those which are normal to the axis of revolution of the body of rotation.

The hyperboloids of revolution are arranged in such a way that their axes are located in planes, which are parallel to each other, or that each of them has a generating line which is parallel to the yarn formation line in the gap therebetween. This achieves, on the one hand, the yarn formation by twisting and, on the other hand, also a conveying of the forming yarn to the outlet of the spinning apparatus. This means that, with projection of the two axes in respective planes, the angle between them is twice as big as the angle at which each yarn generating line intersects its respective hyperboloid axis, i.e., as the apparatus is viewed in FIG. 1.

Moreover, the hyperboloids of revolution are arranged in such a way that the narrowest gap formed by the adjacent generatrices is essentially rectangular, i.e., a narrow, straight line. Since one of the bodies preferably is movable and rotatable around an axis, it is possible to adjust the width of the opening and/or to incline the hyperboloid body in such a way that the most narrow opening gets narrower towards the yarn outlet. Then the friction forces, which are exerted by the drums on the fibers which are consolidating into a yarn, increase with the degree of consolidation. There can be avoided, on the one hand, that the fiber body in its state of orientation is subjected to torsion or tension, respectively, which is too great and causes the breaking of the fiber bond. On the other hand, with the gap becoming narrower toward the outlet of the yarn, torsion exerted on the yarn, which leaves the spinning apparatus, will now be so high that twisting takes place. The dimensions of the narrowest gap are adjusted in such a way that in the upstream feeding zone the gap width is twice as large as the diameter of the yarn produced and in the outlet zone it is smaller than the diameter of the yarn produced.

The drums 1 and 2 in FIG. 1 are rotatably driven in the same direction of rotation by the motors 5 and 6. One or both of said motors may be mounted on a pivotable and/or shiftable mounting to adjust the gap between the drums as described above. Ducts 3 and 4 are connected to a vacuum source (not shown). They in turn are connected to nozzle units 3*a* and 4*a* inside each drum, which units have rectangular air entrant openings extending along the gap between. As disclosed in the aforesaid Dammann et al application, the gap-adjacent edge of each rectangular air entrant openings slightly overlap. The overlapping zone preferably begins before the gap, as seen in the direction of the feed. The maximum width of the overlapping is 10× the diameter of the yarn produced.

Here the diameter of the yarn refers to the finished, twisted yarn and is calculated according to the following formula:

$$d\ (mm) = (1.12838/(g/cm^3) \times Nm,)$$

means here the specific weight and Nm (Number metric) means the fineness of the yarn, measured as meters per gram.

Air currents drawn into the air entrant openings coact with the moving drum surfaces to twist the fibers into a yarn, as more fully disclosed in the Dammann et al application.

Differing from FIG. 1, FIG. 2 shows a spinning apparatus as defined in the present invention where the air permeable surfaces are formed by truncated cones 21 and 22. These truncated cones are designed and arranged in such a way that their imaginary apexes essentially intersect. The direction of the yarn formation or the running direction of the yarn, respectively, goes from the larger to the smaller end. Otherwise, the illustrated parts of the apparatus and the reference marks correspond to those of FIG. 1.

The fiber feed unit consists in both embodiments of a fiber-feed channel 9 having a slotlike mouth and protruding into the narrowest gap between the hyperboloid bodies 1 and 2 or between truncated cones 21,22, respectively, where the orifice extends over at least a portion, preferably ⅔ of the length of the gap. The fiber feed device has a conveying roller 12 and a disentangling roller 13 provided with teeth by means of which the cable or two 10 of filaments or fibers of natural origin or of a synthetic textile polymer is fed and is separated into individual fibers 11. The finished yarn is drawn off by a winding device, possibly with interposition of a delivery mechanism 8 with constant pull-off speed.

During operation, the surface speed of the hyperboloids or the truncated cones, respectively, is carefully adjusted, on the one hand, to the twisting which is to be attained and, on the other hand, to the draw-off speed of the yarn produced. A compromise must be made also with the endurable tension on the yarn. The draw-off speed especially is limited by the fact that the yarn, on the one hand, must not be subjected to tension which is too great and, on the other hand, must not be slack.

It is thought that the invention and its numerous attendant advantages will be fully understood from the foregoing description, and it is obvious that numerous changes may be made in the form, construction and arrangement of the several parts without departing from the spirit or scope of the invention, or sacrificing any of its attendant advantages, the forms herein disclosed being preferred embodiments for the purpose of illustrating the invention.

The invention is hereby claimed as follows:

1. In an apparatus for the open-end spinning of fibers into a yarn which comprises a pair of rotatable bodies whose surface of revolution taper in the longitudinal direction from an end of larger diameter to an end of smaller diameter, means for rotatably driving said bodies in the same direction of rotation, said bodies being positioned to provide therebetween a narrow gap, and means for conveying individual fibers in a current of air onto said surface, for spinning into said yarn characterized by the fact that said tapered surfaces respectively correspond to a segment of a hyperboloid of revolution, said segment being entirely on one side of the plane of symmetry of the hyperboloid of revolution, which plane is normal to the axis of rotation of said hyperboloid of revolution, said surfaces being positioned relative to each other at said gap to impart axial thrust to the yarn formed therebetween in the direction from the larger diameter end of said surfaces toward the smaller diameter end thereof.

2. Apparatus as claimed in claim 1 wherein said smaller diameter end of each surface lies in the plane of symmetry of its hyperboloid of revolution, and said larger diameter end of each surface lies in a plane normal to the axis of rotation and spaced the same distance in each case to its plane of symmetry.

3. Apparatus as claimed in claim 2, fiber-feed means having a channel for feeding discrete fibers into said gap, said channel having a narrow, elongated mouth extending essentially parallel to said gap, the angle between said gap and the plane of said mouth being less than 20°, and said mouth having a length which is approximately ⅔ of the length of said surfaces of revolution, beginning with the zone adjacent said ends of larger diameter of said surfaces.

4. Apparatus as claimed in claim 1, wherein said smaller diameter end of each surfaces lies near but spaced the same distance from the plane of symmetry of its hyperboloid of revolution, and said larger diameter end of each surface lies in a plane normal to the axis of rotation and spaced the same distance in each case to its plane of symmetry.

5. Apparatus as claimed in claim 1, wherein the axes of said hyperboloids of revolution are oriented to provide therebetween an angle of 30°, and each of said axes lies at an angle of 15° relative to the line of yarn formation through said gap.

6. Apparatus as claimed in one of claims 1 to 5 wherein said surfaces of the pair of rotatable bodies are perforate, air permeable surfaces and said means for conveying individual fibers is a suction means drawing air through said surfaces adjacent said narrow gap.

* * * * *